United States Patent [19]

Hafstad

[11] Patent Number: 4,753,603

[45] Date of Patent: Jun. 28, 1988

[54] WHOLLY ENCLOSED ARMATURE ARRANGEMENT FOR FLUORESCENT TUBES

[76] Inventor: Bjorn Hafstad, N-9405 Kanebogen, Kanebogen, Norway

[21] Appl. No.: 936,346

[22] PCT Filed: Mar. 26, 1986

[86] PCT No.: PCT/NO86/00027

§ 371 Date: Nov. 14, 1986

§ 102(e) Date: Nov. 14, 1986

[87] PCT Pub. No.: WO86/05857

PCT Pub. Date: Oct. 9, 1986

[30] Foreign Application Priority Data

Mar. 26, 1985 [NO] Norway ..... 851203

[51] Int. Cl.[4] ..... H01R 33/02

[52] U.S. Cl. ..... 439/226; 439/235; 439/243; 439/375; 439/541

[58] Field of Search ..... 439/226, 228, 229, 230–238, 439/242, 243, 244, 374, 375, 377–381, 683, 541–543; 362/217, 260

[56] References Cited

U.S. PATENT DOCUMENTS 2,337,745 12/1943 Garstang ..... 362/217

3,278,886 10/1968 Blumenberg ..... 439/683

3,426,234 2/1969 Hayasaka et al. ..... 439/226

4,084,873 4/1978 Grate ..... 439/226

4,275,325 6/1981 Guim ..... 439/375

4,298,918 11/1981 Metcalf ..... 362/217

*Primary Examiner*—David Pirlot

*Attorney, Agent, or Firm*—Kenyon & Kenyon

[57] ABSTRACT

A wholly enclosed armature for fluorescent tubes, which is designed for outdoor use, has a transparent, cylindrically tubular cover member (18) which supports at the one end a permanent coupling housing (23) and at the opposite end supports an easily detachable end cover (22). A fluorescent tube-carrying support arrangement (24) is axially displaceably received in the cover member (18) between the coupling housing (23) and the end cover (22). The inner end of the support arrangement (24) is provided with guide members (42,43) of a first type which cooperate with guide members (47–49) of an equivalent second type on the coupling member. The support arrangement and the coupling member are provided with their respective contact members which form a current connection between the support arrangement and the coupling member and which are relatively moveable inwardly into and outwardly from engagement with each other guided by the said guide members (42,43; 47–49).

9 Claims, 1 Drawing Sheet

WHOLLY ENCLOSED ARMATURE ARRANGEMENT FOR FLUORESCENT TUBES

The present invention relates to a wholly enclosed armature arrangement for fluorescent tubes. More particularly, this invention relates to a fluorescent tube armature for outdoor use.

Heretofore, various types of fluorescent tube armatures have been known for the mounting of fluorescent tubes. Generally, these armatures have been constructed with a transparent or translucent tubular cover member which can be supported at one end in a coupling housing and at the other end in the detachable end cover. In some cases, suitable electrical coupling means have also been provided in the coupling housing. As is known, in those armatures designed for outdoor use, there is a need to be able to replace the fluorescent tubes in a ready manner, as required, and also during relatively unfavourable weather conditions, if this is necessary, without thereby allowing moisture to gain access to a substantial degree to the electrical coupling means. In many instances it may be necessary to have to exchange fluorescent tubes in the dark and if necessary during work on a ladder or under similarly complicated working conditions.

There is also a need to produce a double-insulated armature which is convenient to manufacture and at the same time is simple to use, that is to say which has a simple construction and which at the same time is sufficiently tight and reliable on use and which is readily accessible for replacement of fluorescent tubes and remaining parts, without the danger of coming into contact with current-conducting leads.

Accordingly, it is an object of the invention to provide a fluorescent tube armature of simple construction in which replacement of fluorescent tubes can be readily performed.

It is another object of the invention to permit replacement of fluorescent tubes in an outdoor armature without the risk of contacting current-conducting leads.

It is another object of the invention to simplify the task of exchanging spent fluorescent tubes in an outdoor armature.

Briefly, the invention provides a fluorescent tube armature which is comprised of a tubular cover member, a coupling housing secured to one end of the cover member for connection to an electrical lead, an end cover which is detachably connected to an opposite end of the cover member and a support arrangement for at least one fluorescent tube slidably mounted in the cover member.

The arrangement according to the invention is characterised in that the inner end of the support arrangement is equipped with one or more eccentrically arranged, axially extending first type guide members which cooperate with one (or more) equivalent, eccentrically arranged axially extending second type guide members on the coupling housing. In addition, the support arrangement and the coupling housing are provided with a pair or a set of equivalent electrical contact members which form a current connection between the coupling housing and the support arrangement and which are relatively moveable inwardly into and outwardly from engagement with each other over an axial distance of movement which is defined within the guide-engagement-forming movement zone of the guide members of the support arrangement and the coupling member.

According to the invention, the support arrangement with associated fluorescent tubes and other fittings can be drawn out from the cover member as a coherent unit and after replacing the fluorescent tubes or other fittings can be placed back in position in a ready manner by a simple axial displacement of the support arrangement relative to the cover member. By means of the guide members of the support arrangement and the coupling member it is possible to ensure a correct angular adjustment of the support arrangement relative to the cover member before the electrical contact members are pushed axially together during simultaneous axial pushing in of the support arrangement into the cover member. By this one ensures that the contact members are brought without the danger of being damaged into precise engagement with each other and are guided in a controlled manner relative to each other during the displacement of the contact members. Likewise, it is ensured that the contact members are first brought into engagement with each other after the guide members have consolidated an accurate guiding engagement with each other. In this way it will also be possible to break the current supply and establish the current connection between the support arrangement and the coupling member within the zone of movement of the guide members where they have a cooperating guiding engagement and thereby be able to ignite (or extinguish) the fluorescent tubes immediately the contact means come into engagement with each other (or are brought out of engagement with each other). By this the coupling (or uncoupling) can take place in a shielded manner and with an effective simultaneous control that the fluorescent tube functions as intended.

Further features of the invention will be evident from the following description having regard to the accompanying drawings, in which.

Figure 1:
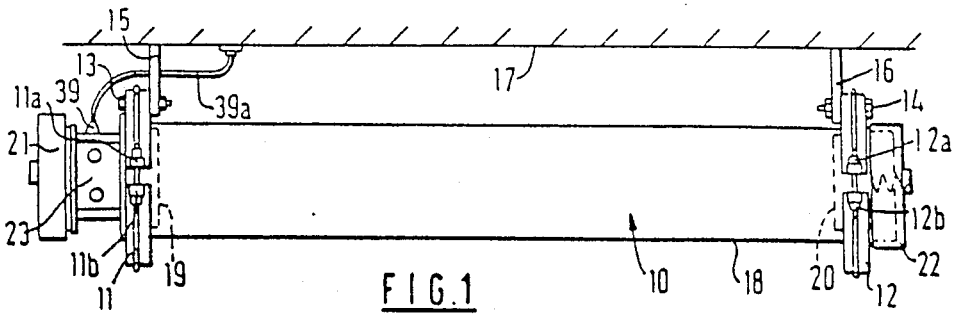
FIG. 1 shows the armature according to the invention fixed to a base, seen from above.

In FIG. 1 there is shown a fluorescent tube armature 10 which is fixed at two opposite ends via ringforming support means 11, 12 and associated fastening bolts 13, 14 to fastening ears 15, 16 on a base 17. The exhibited suspension arrangement is shown as an illustrating embodiment, the suspension being able to be effected in arbitrary ways known per se for different types of fastening members or different types of bases without this being shown further herein.

The fluorescent tube armature 10 comprises a transparent or translucent, cylindrically tubular cover member 18 of plastic, glass or other suitable material and manufactured in arbitrary lengths. At opposite ends of the cover member there are pushed in and secured socket members 19 and 20 which are provided with an inner fastening portion 19*a*, 20*a* (see FIGS. 2 and 3) and an outer, externally threaded portion 19*b*, 20*b* together with a central collar portion 19*c*, 20*c* projecting radially outwards. The collar portion 19*c*, 20*c* can form end stops for an adjacent ring-forming support means 11 and 12 at each end of the armature. The ring-forming support means 12 (11) is adapted to be clamped via fastening means 12*a*, 12*b* (11*a*, 11*b*) on the outer side of the cover member 18 raidally outside fastening portion 20*a* of the socket member, fastening portion 20*a* of the socket member being able to support and brace the cover member 18 in the region where the support means 12 (11) is most loaded, that is to say where it is adapted to be clamped to the cover member 18.

Figure 2:
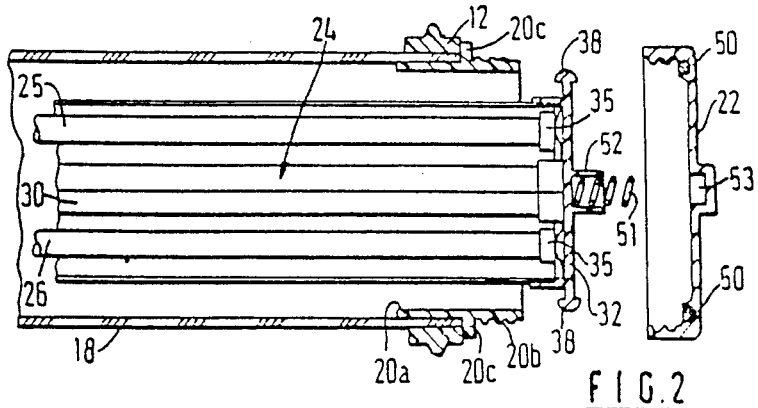
FIG. 2 shows an exploded sectional view of one end of the armature in accordance with the invention.
Figure 3:
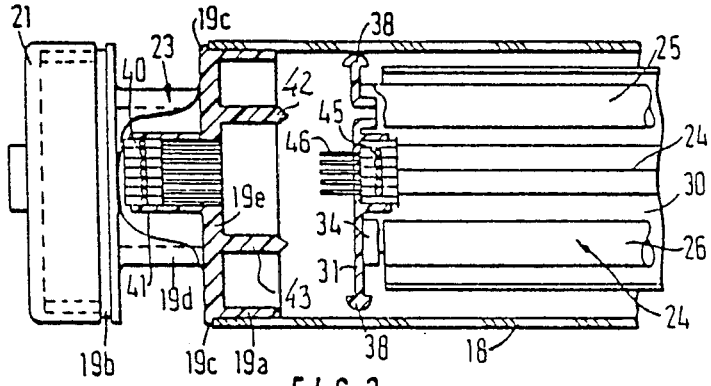
FIG. 3 shows a portion of the other end of the armature with the current connection disconnected between the parts.

An end cover 21, 22, respectively, is secured to the respective threaded portions 19*b*, 20*b* of the socket members 19, 20 so that optional access can be provided to the respective ends of the armature. In addition, a coupling housing 23 is secured to one end of the cover member 18 while a support arrangement 24 is slidably mounted within the cover member 18. As indicated in FIGS. 2 and 3, the support arrangement 24 is axially movable relative to the coupling housing 23 as well as to the cover member 18.

The support arrangement 24 (FIGS. 2 and 3) axially moveable relative to the coupling housing 23 and the cover member 18. The support arrangement 24 carries a pair of fluorescent tubes 25, 26 and a pair of discharge igniters fixed to two opposite end components 31, 32 and an impedance coil and the like fixed to a light reflector shield 30, which in turn is fixed to the two opposite end components 31, 32.

The end components 31, 32 are permanently secured via support pins 33 to the light reflector shield 30 to form a support arrangement rigid to bending. To the end components 31, 32 there are fastened contact-forming holding means 34, 35 for the fluorescent tubes 25, 26 together with a contact-forming holding means 36 for the respective discharge igniters. At the periphery of the end components 31, 32 there are arranged support lugs 38 which are adapted to form support and guide members for the end component 31, 32 against the cover member 18 on axially displacing the support arrangement 24 relative to the cover member 18.

The coupling housing 23 is combined in the illustrated embodiment with the one socket member 19 and comprises an essentially square housing member 19*d* which is inserted between the externally threaded portion 19*b* and the collar portion 19*c*. To the coupling housing there is connected a transverse base member 19*e* which is arranged just by the collar portion 19*c*.

To the housing member 19*d* there is fixed an insertion nipple 39 for an electrical lead 39*a* which is coupled to one or more contact means 40 (FIG. 3) fastened to a holder 41 on the base member 19*e*. The contact means 40 has a series of contact points separately located on the side of the base member 19*e* which faces inwardly into the hollow space of the cover member 18. On the same side of the base member 19*e* there project axially inwards into the hollow space of the cover member three eccentrically arranged guide members in the form of pins, of which only two guide pins 42, 43 are shown in the drawing.

Figure 4:
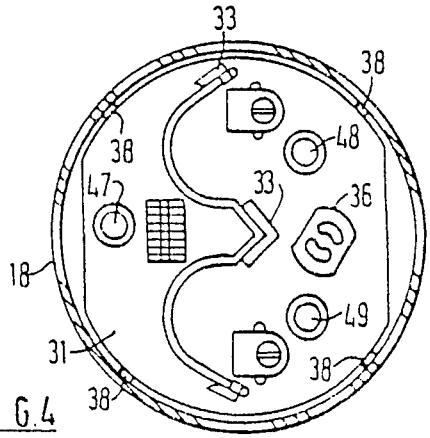
FIG. 4 shows an end view of one end component of the support arrangement.

On one, inwardly facing end component 31 of the support arrangement there is fastened a contact means 45 with a series of contact pins 46 projecting endways outwards which are adapted to be threaded into engagement with their respective contact point on the contact means 40 on pushing in the support arrangement 24 into the cover member 18. In order to ensure a correct, accurate joining of the contact pins 46 into contact points of the contact means 40 provision is made for guiding the end component axially along the guide pins 42 and 43, the guide pins engaging with three equivalent socket members 47, 48, 49 (FIG. 4) in the end component 31. Provisions is made that the guide members 42 and 43, and 47, 48, 49 in the region for establishing electrical contact via the contact means 40 and 45, via the contact pins 46 and associated contact points, ensure a precise parallel displacement of the support arrangement 24 relative to the cover, while the guide members axially outside this region can ensure a centering of the support arrangement relative to the cover member. In this connection the guide pins 42, 43 are provided at the outer end with somewhat pointed pin ends 42*a* and 43*a*, so that the guide pins 42–43 can be readily threaded into place in the guide sockets 47–49, while front edges of the guide sockets 47–49 are arranged flush with the front side of the end component 31.

According to the invention there is achieved a double-insulated armature, where the assembly and disassembly of the support arrangement 24 with associated fluorescent tubes 25 and 26 can take place in an adequate manner without the danger of coming into contact with current-conducting leads, thanks to the cooperating guide members 42, 43 and 47, 38, 49. Furthermore there is obtained an especially simple construction by firstly allowing the support arrangement or support beam to consist of a coherently rigid unit of the end components 31, 32 and the reflector shield 30. The reflector shield 30 as a consequence of its profile form provides great rigidity and strength at the same time as it shields the fluorescent tubes 25, 26, in the associated hollow space on the one side, and impedance coil, lead connections and the like in an associated hollow space on the opposite side. The end components 31, 32 for their part support in an easily accessible way all necessary fastenings for fluorescent tubes, contact means and the like. Secondly the remaining, outer construction of the armature can have a simple design due to the tubular cover member 18 at the ends forming supports for the socket members 19, 20 and at the same time fastenings for the ring-forming support means 11, 12 and due to the one socket member 19 being combined with the coupling housing 23. by utilising and end cover 21 and 22 respectively on each of the socket members 19, 20 access can be easily provided as required to the vital parts of the coupling housing 23 and to the support arrangement 24 and its vital parts. Between the socket member 19 (20) and the end cover 21 (22) there is inserted a sealing ring 50, and between the outer end component 32 of the support arrangement and the adjacent end cover 22 there is inserted a compression spring 51 which rests in a spring holder 52 in the end component 32 and rests in a cavity 53 in the end cover 22. By means of the spring 51 one can ensure that the support arrangement 24 is axially in place in an abutment against the inner end of the cover member independently of the seal between the socket member 20 and the end cover 22.

The different dimensions of fluorescent tubes of current interest can be adapted in a ready manner according to the invention by quite simply adapting correspondingly the lengths of the reflector shield 30 and the cover member 18.

I claim:

1. A wholly enclosed armature for fluorescent tubes (25, 26), designed for outdoor use, where a transparent or translucent, cylindrically tubular cover member (18) supports at one end a permament coupling housing (23) and at the opposite end supports an easily detachable end cover (22) and where a fluorescent tube-carrying support arrangement (24) is axially displaceably received in the cover member (18) between the coupling housing (23) and the end cover (22), characterised in that the inner end of the support arrangement (24) is equipped with one or more eccentrically arranged, axially extending first type guide members (47, 48, 49) which cooperate with one or mroe equivalent eccentrically arranged axially extending second type guide members (42, 43) on the coupling housing (23), and that the support arrangement (24) and the coupling housing (23) are provided with electrical contact members (46) which form a current connection between the coupling housing (23) and the support arrangement (24) and which are relatively moveable inwardly into and outwardly from engagement with each other over an axial distance of movement which is defined within a guide engagement-forming region of movement of the guide members of the support arrangement and the coupling member.

2. Arrangement in accordance with claim 1, characterised in that the support arrangement (24) consists of two end components (31, 32) which extend transversely of and are separately rigidly fastened to an intermediate, support member braced by means of a profile shape designed as a reflector shield (30), said end components (31, 32) forming a fitting and coupling for the fluorescent tubes (25, 26), while the reflector shield (30) forms a fitting for transformers and the like, and that the one, inner end component (31) forms a support for contact members and guide members (47–49) which cooperate with the contact members and the guide members (42, 43) in the coupling housing (23) of the cover member (18).

3. Arrangement in accordance with claim 2, characterised in that the coupling housing (23) is formed by a housing component fixed to the end of the cover member (18) with at the one end an associated fastening portion (19*b*) for an easily detachable end cover (20) and at the opposite end with a base member (19*e*) which forms a support for contact members and guide members (42, 43) of the coupling housing.

4. A fluorescent tube armature comprising a tubular cover member;

a coupling housing secured to one end of said cover member for connection to an electrical lead;

an end cover detachably connected to an opposite end of said cover member;

a support arrangement for at least one fluorescent tube slidably mounted in said cover member;

eccentrically disposed guide members between said coupling housing and said support arrangement for aligning and guiding said support arrangement relative to said coupling housing over a predetermined axial distance; and electrical contact members between said coupling housing and said support arrangement for forming an electrical connection therebetween, said contact members being moveable relative to each other over said axial distance.

5. A fluorescent tube armature as set forth in claim 4 wherein said support arrangement includes a pair of end components, a support member fastened to and between said end components, and a profiled reflector shield fastened to and between said end components.

6. A fluorescent tube armature as set forth in claim 5 wherein said guide members includes elongated pins on one of said coupling housing and a respective end component and sockets on the other of said coupling housing and said respective end component.

7. A fluorescent tube armature as set forth in claim 5 wherein said contact members include contact pins on one of said end components and contact means on said coupling housing to electrically contact said pins.

8. A fluorescent tube armature as set forth in claim 5 wherein said coupling housing inlcudes a socket member receiving said cover member thereon and including a transverse base member having said guide members and said contact members thereon.

9. A fluorescent tube armature as set forth in claim 5 which further comprises a detachable cover on said coupling housing.

* * * * *

UNITED STATES PATENT AND TRADEMARK OFFICE

CERTIFICATE OF CORRECTION

PATENT NO. : 4,753,603

DATED : June 28, 1988

INVENTOR(S) : Bjorn Hafstad

It is certified that error appears in the above-identified patent and that said Letters Patent is hereby corrected as shown below:

Column 3, line 3 "raidally" should be -radially-
Column 3, lines 19 to 21 cancel "The ... member 18."

Column 4, line 2 "Provisions" should be -Provision-
Column 4, line 42 "by" should be -By-
Column 4, line 42 "and end" should be -an end- Signed and Sealed this Twenty-ninth Day of November, 1988

*Attest:*

DONALD J. QUIGG

*Attesting Officer*

*Commissioner of Patents and Trademarks*